US010024076B1

(12) United States Patent
Hamm

(10) Patent No.: US 10,024,076 B1
(45) Date of Patent: Jul. 17, 2018

(54) SHELTER AND METHOD OF USE

(71) Applicant: Mark Edward Hamm, Harbinger, NC (US)

(72) Inventor: Mark Edward Hamm, Harbinger, NC (US)

( * ) Notice: Subject to any disclaimer, the term of this patent is extended or adjusted under 35 U.S.C. 154(b) by 0 days.

(21) Appl. No.: 15/730,189

(22) Filed: Oct. 11, 2017

(51) Int. Cl.
*E04H 15/00* (2006.01)
*E04B 1/343* (2006.01)
*E04H 15/64* (2006.01)
*E04H 15/32* (2006.01)

(52) U.S. Cl.
CPC ..... *E04H 15/008* (2013.01); *E04B 1/34321* (2013.01); *E04H 15/64* (2013.01); *E04H 2015/326* (2013.01)

(58) Field of Classification Search
CPC ..... E04H 15/008; E04H 15/48; E04H 15/04; E04H 15/36; E04H 15/54; E04B 1/34321; E04B 1/40
See application file for complete search history.

(56) References Cited

U.S. PATENT DOCUMENTS 2,079,635 A * 5/1937 Sharp ..... B63B 3/68 114/71
2,388,297 A * 11/1945 Slaughter ..... B29C 65/5085 428/53
3,661,689 A * 5/1972 Spanier ..... E04H 15/32 24/DIG. 50
3,739,833 A * 6/1973 Rausch ..... B22D 7/108 164/137
3,975,877 A * 8/1976 Walton ..... E04B 2/7854 312/111
4,237,671 A * 12/1980 Munson ..... E04F 19/00 52/28
4,454,694 A * 6/1984 Davanture ..... E04B 1/34321 52/270
4,594,829 A * 6/1986 Herrgord ..... E05D 1/04 52/282.3
4,719,716 A * 1/1988 Chrisley, Jr. ..... E04H 1/1205 43/1
4,828,132 A * 5/1989 Francis, Jr. ..... B65D 11/1853 16/225
4,969,568 A * 11/1990 Yoshida ..... B43M 99/008 211/186
5,187,843 A * 2/1993 Lynch ..... A44B 19/16 24/453

(Continued)

*Primary Examiner* — Beth A Stephan
(74) *Attorney, Agent, or Firm* — Ted Masters

(57) ABSTRACT

A shelter is made from a plurality of connectable panels. The panels include a first panel which has a side edge, an exterior, and an interior, and a second panel which has a side edge, an exterior, and an interior. A connector is configured to hold the side edge of the first panel in abutting relationship with the side edge of the second panel. The connector includes an exterior segment which is configured to connect the exterior of the first panel to the exterior of the second panel, and an interior segment which is configured to connect the interior of the first panel to the interior of the second panel. The exterior and interior segments each include elastic cords which resiliently hold the two panels together. The edges of adjacent panels include ridges and mating grooves, and the panels include a viewing aperture which can be closed with a plug.

14 Claims, 11 Drawing Sheets

(56) References Cited

U.S. PATENT DOCUMENTS

| | | | | | |
|---|---|---|---|---|---|
| 5,377,857 | A * | 1/1995 | Taravella | B65D 5/006 | 206/512 |
| 5,487,690 | A * | 1/1996 | Stoffle | A63H 33/10 | 16/225 |
| 6,241,148 | B1 * | 6/2001 | Schwimmer | B65D 5/32 | 206/600 |
| 6,749,077 | B1 * | 6/2004 | McAlpine | B65D 11/1833 | 220/4.29 |
| 8,904,706 | B1 * | 12/2014 | Smith | A01G 9/027 | 47/65.6 |
| 8,997,436 | B2 * | 4/2015 | Spear | E04F 13/0894 | 52/239 |
| 9,016,485 | B1 * | 4/2015 | Liu | A47B 47/0075 | 211/183 |
| 2002/0056247 | A1 * | 5/2002 | Williams | A01K 1/0041 | 52/648.1 |
| 2004/0118061 | A1 * | 6/2004 | Little | E04L 32/7854 | 52/270 |
| 2007/0245640 | A1 * | 10/2007 | Bergqvist | E02D 5/56 | 52/92.2 |
| 2008/0279634 | A1 * | 11/2008 | Heselden | E01F 8/025 | 405/114 |
| 2015/0300008 | A1 * | 10/2015 | Gosling | E04C 2/288 | 52/506.05 |

* cited by examiner

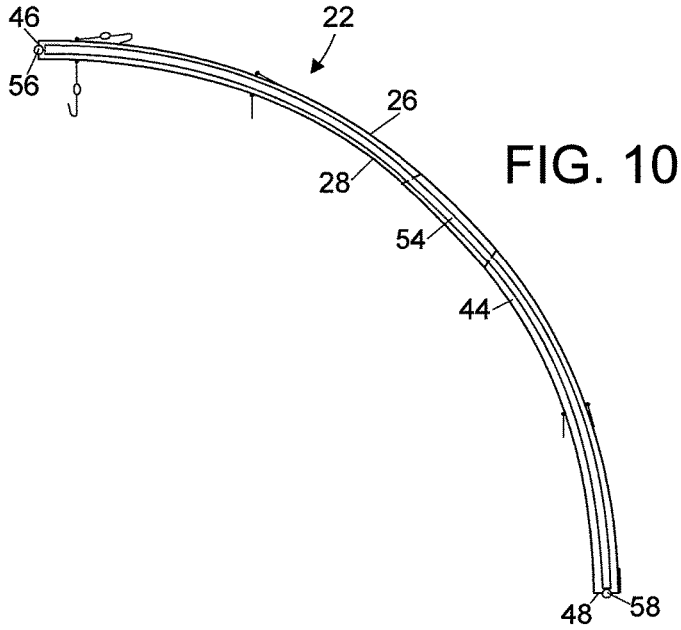
FIG. 10
FIG. 11
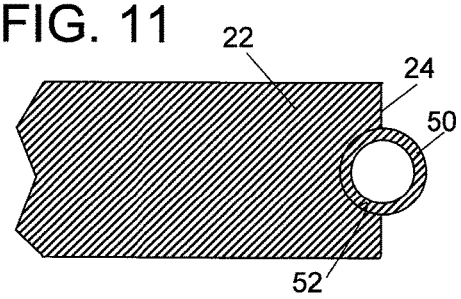
FIG. 13
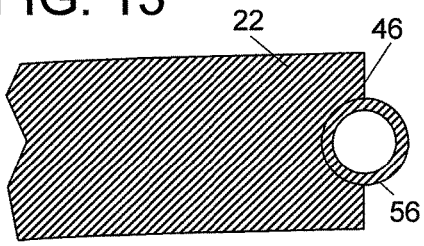
FIG. 12
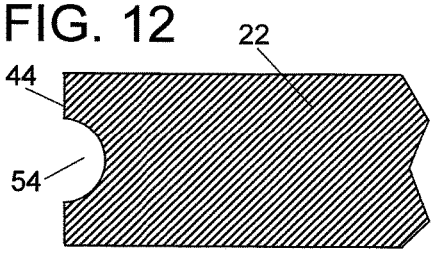
FIG. 14
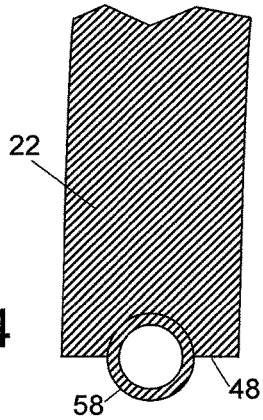

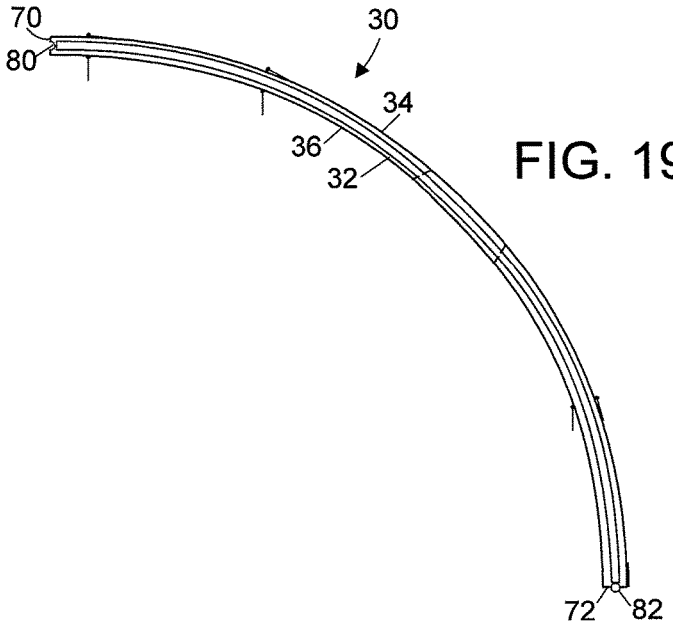
FIG. 19
FIG. 20
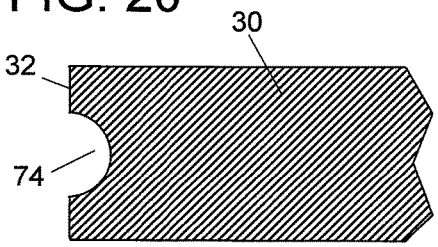
FIG. 22
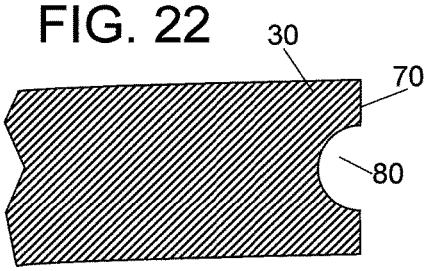
FIG. 21
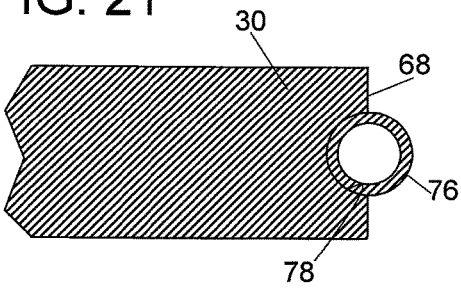
FIG. 23
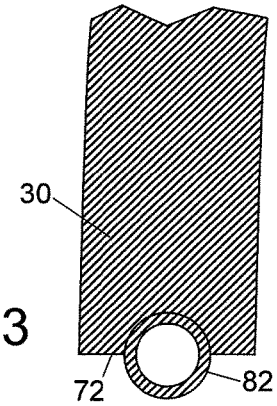

FIG. 33
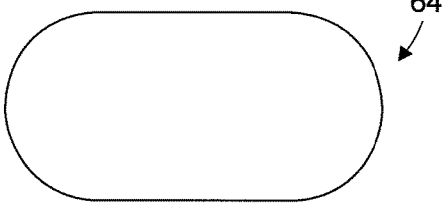
FIG. 35
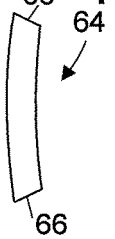
FIG. 34
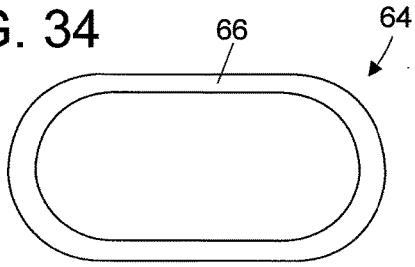
FIG. 36
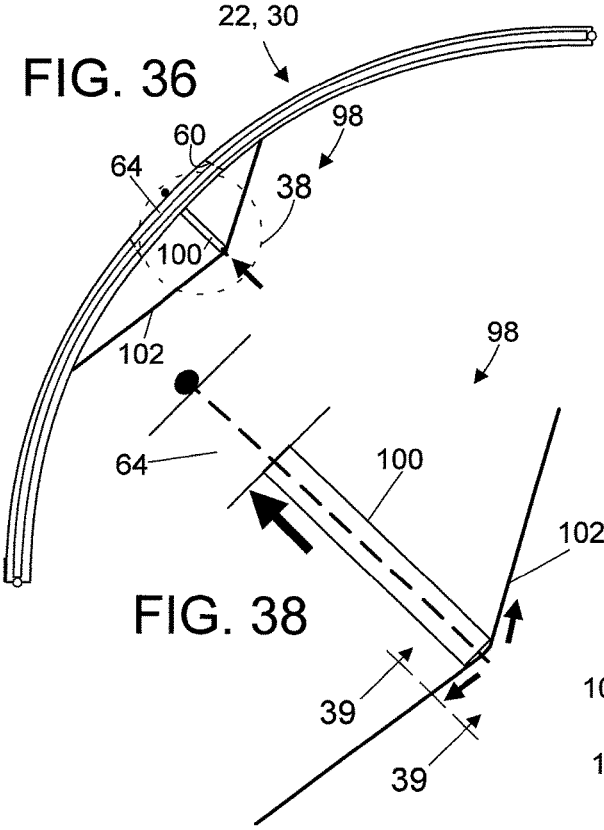
FIG. 37
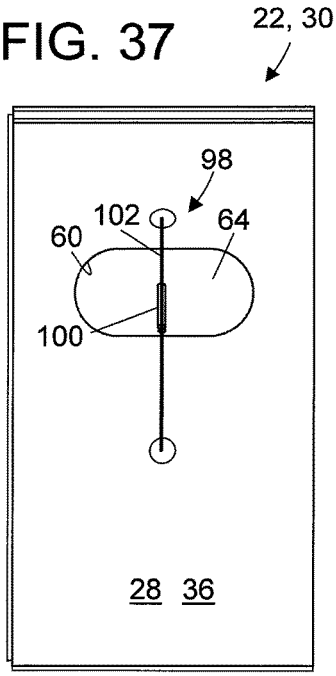
FIG. 38
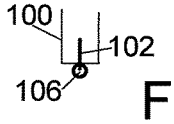
FIG. 39

FIG. 40
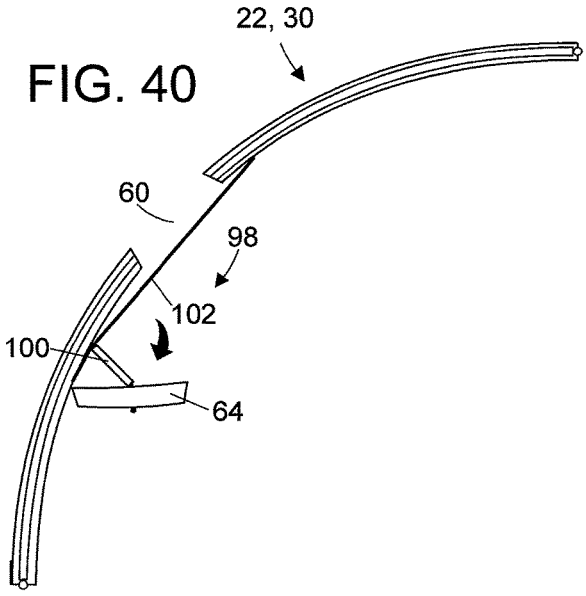
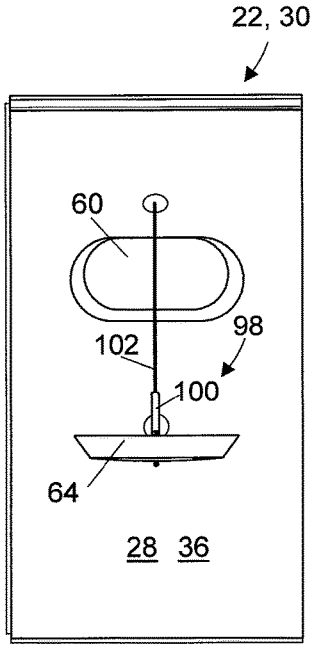
FIG. 41
FIG. 42
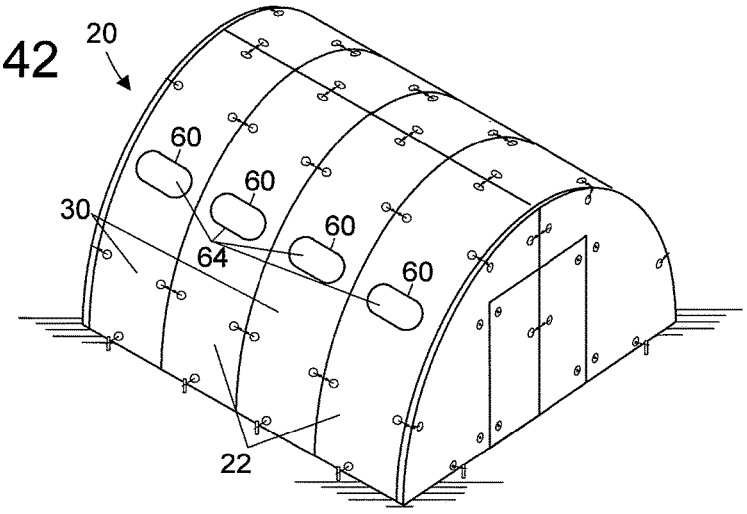

SHELTER AND METHOD OF USE

CROSS REFERENCE TO RELATED APPLICATION

None

TECHNICAL FIELD

The present invention pertains generally to shelters, and more particularly to a modular shelter which can be transported to a site in sections, and assembled at the site.

BACKGROUND OF THE INVENTION

Shelters are known in the art, and are used for camping, hunting, fishing, and other excursions into the wild. These structures range from large permanent buildings to portable units such as tents. The shelters provide protection from wind, rain, snow, and some provide thermal insulation from temperature extremes.

BRIEF SUMMARY OF THE INVENTION

The present invention is directed to a modular shelter which can be transported in panel sections to a shelter site. At the site the panel sections are assembled to form the shelter. The resulting shelter is lightweight, strong, and because it is made from foam, the shelter provides a high degree of thermal insulation from the environment. The shelter panels are connected together using a connector which has both exterior and interior components. The shelter is particularly useful for ice fishing, where it covers a hole in the ice.

In accordance with an embodiment, a shelter includes a plurality of panels including a first panel which has a side edge, an exterior, and an interior, and a second panel which has a side edge, an exterior, and an interior. A connector is configured to hold the side edge of the first panel in abutting relationship with the side edge of the second panel. The connector includes an exterior segment which is configured to connect the exterior of the first panel to the exterior of the second panel, and an interior segment which is configured to connect the interior of the first panel to the interior of the second panel.

In accordance with another embodiment, the exterior segment includes an exterior elastic cord which is configured to pull the first panel and the second panel together, and the interior segment includes an interior elastic cord which is configured to pull the first panel and the second panel together.

In accordance with another embodiment, the exterior segment includes an exterior hook which is configured to engage an exterior loop, and the interior segment includes an interior hook which is configured to engage an interior loop.

In accordance with another embodiment, the exterior of the first panel includes an exterior resin inset which has a hole which is configured to receive the exterior elastic cord. The interior of the first panel includes an interior resin inset which has a hole which is configured to receive the interior elastic cord.

In accordance with another embodiment, the first panel and the second panel are each fabricated from foam.

In accordance with another embodiment, the side edge of the first panel includes one of a ridge and a groove, and the side edge of the second panel includes the other of the ridge and the groove.

In accordance with another embodiment, the ridge is a rod.

In accordance with another embodiment, the first panel has a bottom edge, the bottom edge of the first panel includes a bottom ridge. The second panel has a bottom edge, the bottom edge of the second panel includes a bottom ridge.

In accordance with another embodiment, the first panel has a top edge, the top edge of the first panel includes one of a top ridge and a top groove. The second panel has a top edge, the top edge of the second panel includes the other of the top ridge and the top groove.

In accordance with another embodiment, the first panel and the second panel each include an embedded support frame.

In accordance with another embodiment, the first panel includes a viewing aperture. A plug is shaped and dimensioned to removably fit into the viewing aperture.

In accordance with another embodiment, a lock is configured to hold the plug in place within the viewing aperture. The lock includes a sleeve which cooperates with an elastic plug cord, wherein the sleeve is positionable to a locked position in which it perpendicularly abuts the plug.

In accordance with another embodiment, the elastic plug cord has two ends which are connected at different points to the interior of the first panel. In the locked position the sleeve is disposed between the elastic plug cord and the plug, wherein the sleeve urges the plug into the viewing aperture.

Other embodiments, in addition to the embodiments enumerated above, will become apparent from the following detailed description, taken in conjunction with the accompanying drawings, which illustrate, by way of example, the principles of the shelter and method of use.

BRIEF DESCRIPTION OF THE DRAWINGS

FIG. 10 is an opposite edge elevation view of the first panel;

FIG. 11 is an enlarged cross sectional view along the line 11-11 of FIG. 6;

FIG. 12 is an enlarged cross sectional view along the line 12-12 of FIG. 6;

FIG. 13 is an enlarged cross sectional view along the line 13-13 of FIG. 6;

FIG. 14 is an enlarged cross sectional view along the line 14-14 of FIG. 7;

FIG. 19 is an opposite edge elevation view of the second panel;

FIG. 20 is an enlarged cross sectional view along the line 20-20 of FIG. 15;

FIG. 21 is an enlarged cross sectional view along the line 21-21 of FIG. 15;

FIG. 22 is an enlarged cross sectional view along the line 22-22 of FIG. 15;

FIG. 23 is an enlarged cross sectional view along the line 23-23 of FIG. 16;

FIG. 33 is an exterior elevation view of a plug for a viewing aperture;

FIG. 34 is an interior elevation view of the plug;

FIG. 35 is an end elevation view of the plug;

FIG. 36 is an edge elevation view of the first panel or the second panel with the plug installed in the viewing aperture and a lock;

FIG. 37 is an interior elevation view of the first panel or the second panel with the plug installed in the viewing aperture and lock;

FIG. 38 is an enlarged view of area 38 of FIG. 36;

FIG. 39 is a view along the line 39-39 of FIG. 38;

FIG. 40 is an edge elevation view of the first panel or the second panel with the plug removed from the viewing aperture;

FIG. 41 is an interior elevation view of the first panel or the second panel with the plug removed from the viewing aperture;

FIG. 42 is a reduced perspective view of the shelter with plugs installed;

DETAILED DESCRIPTION OF THE INVENTION

Figure 1:
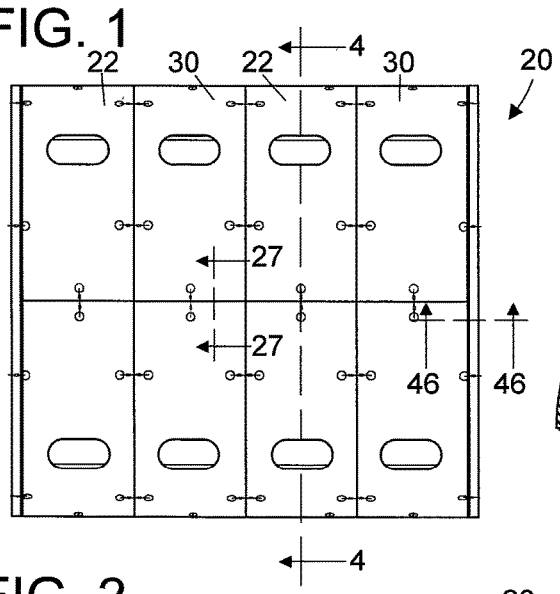
FIG. 1 is a reduced top plan view of a shelter.

Referring initially to FIGS. 1-5, there are illustrated reduced top plan, side elevation, end elevation, cross sectional, and perspective views respectively of a shelter, generally designated as 20. Shelter 20 includes a plurality of panels including a first panel 22 having a side edge 24, an exterior 26, and an interior 28 (also refer to FIGS. 6-10). Shelter 20 also includes a second panel 30 having a side edge 32, an exterior 34, and an interior 36 (also refer to FIGS. 15-19). It is noted that in the shown embodiment, shelter 20 has the shape of a quonset hut, however other shapes such as an igloo are also possible. Also in the shown embodiment, shelter 20 includes two different side panel configurations; first panel 22 and second panel 30. It may be appreciated that other variations and combinations of side panels are also possible. It is further noted that first panels 22 and second panels 30 are disposed in alternate arrangement so that the edges of a first panel 22 are adjacent to the edges of a second panel 30. That is, the edges of two first panels 22 or of two second panels 30 are not adjacent.

First panel 22 and second panel 30 are each fabricated from foam so as to provide a high degree of thermal insulation (high R value). In an embodiment polyurethane foam having a panel thickness of about 2 inches to about 3 inches is utilized.

Shelter 20 is disposed upon a support surface 500 such as the ground or the ice of a frozen body of water. Shelter 20 includes tie-downs 38 which can be connected to stakes 600 to hold shelter 20 in place upon support surface 500.

Figure 24:
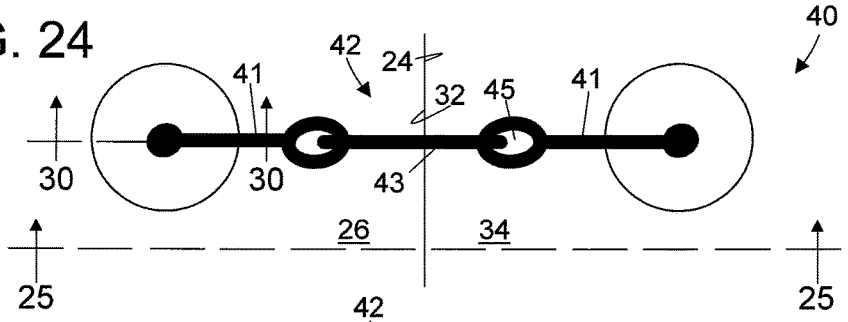
FIG. 24 is an enlarged view of area 24 of FIG. 2.
Figure 25:
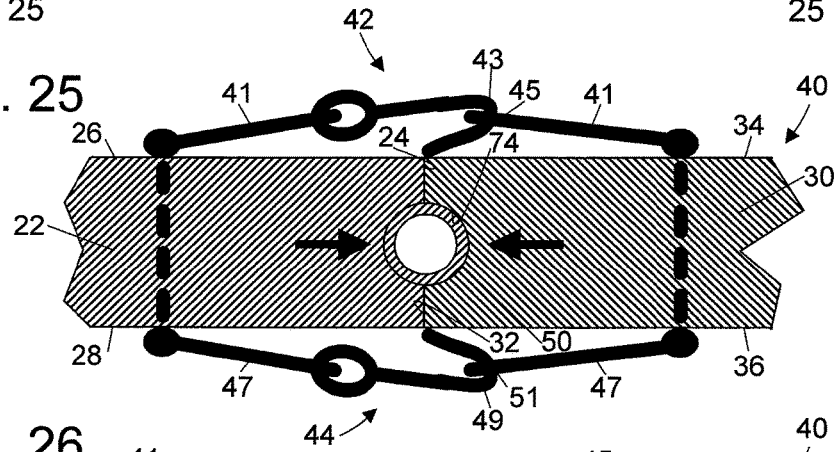
FIG. 25 is a cross sectional view along line 26-25 of FIG. 24 showing the first panel and the second panel connected.
Figure 26:
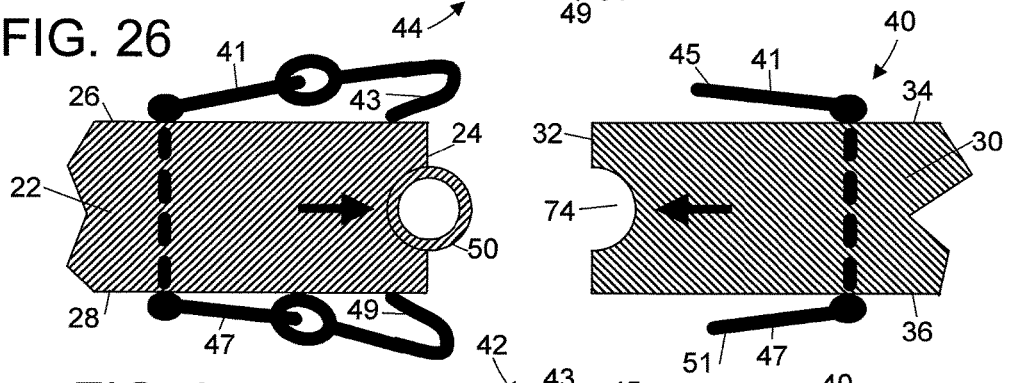
FIG. 26 is a cross sectional view as in FIG. 25 showing the first panel and the second panel before connection.

Also referring to FIGS. 24-26, a connector 40 is configured to hold side edge 24 of first panel 22 in abutting relationship with side edge 32 of second panel 30. Connector 40 includes an exterior segment 42 which is configured to connect exterior 26 of first panel 22 to exterior 34 of second panel 30, and an interior segment 44 which is configured to connect interior 28 of first panel 22 to interior 36 of second panel 30. It is noted that shelter 20 includes a plurality of connectors 40 which are utilized to connect the sides and tops of first panels 22 to second panels 30. The number and placement of connectors 40 depends upon the size and shape of shelter 20, the size and shape of the panels, the desired level of structural strength, and other factors.

FIGS. 6-10 are top plan, exterior elevation, edge elevation, interior elevation, and opposite edge elevation views respectively of first panel 22. In the shown embodiment first panel 22 is shaped in the form of a 90° arc (refer to FIGS. 8 and 10). First panel 22 includes side edge 24, an exterior 26 (i.e. the part which is outwardly facing in FIG. 5), an interior 28 (i.e. the part which is inwardly facing), an opposite side edge 44, a top edge 46, and a bottom edge 48. Side edge 24 includes one of a ridge and a groove. Also referring to FIG. 11, in the shown embodiment side edge 24 includes a ridge 50 which is formed by a rod. In the shown embodiment ridge 50 is a PVC pipe which is fixedly connected (such as by an adhesive) to the wall of a semi-circular cavity 52 which runs along side edge 24. Referring also to FIG. 12, opposite side edge 44 includes a groove 54. That is, in the shown embodiment one side edge 24 of first panel 22 has a ridge 50 which extends the length of the side edge 24, and the opposite side edge 44 has a groove 54 which extends the length of the side edge 44.

Referring also to FIG. 13, top edge 46 includes one of a top ridge and a top groove. In the shown embodiment top edge 46 includes a top ridge 56, which is similarly formed as ridge 50. Referring also to FIG. 14, bottom edge 48 includes a bottom ridge 58, which is similarly formed as ridge 50. Bottom ridge 58 serves as a bumper which protects bottom edge 48 from damaging contact with support surface 500 (refer to FIG. 5).

Figure 4:
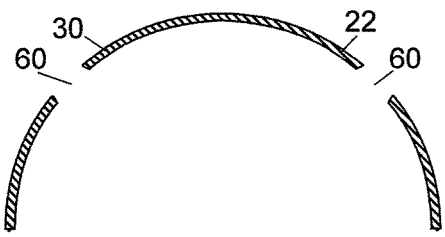
FIG. 4 is a reduced cross sectional view along the line 4-4 of FIG. 1.
Figure 5:
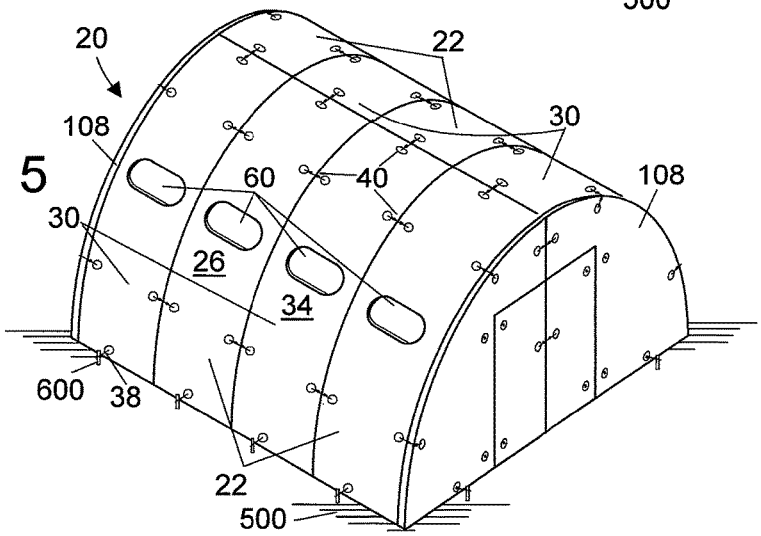
FIG. 5 is a reduced perspective view of the shelter.
Figure 6:
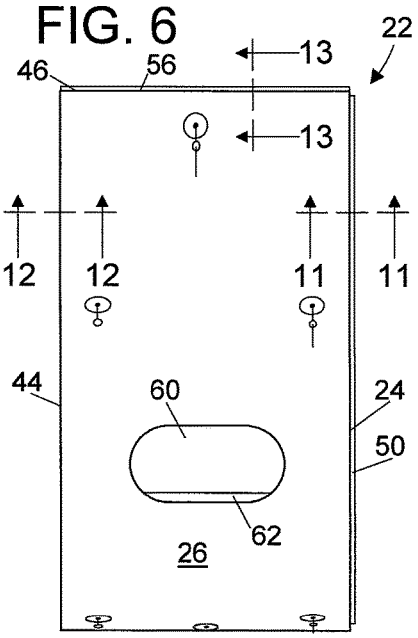
FIG. 6 is top plan view of a first panel.
Figure 9:
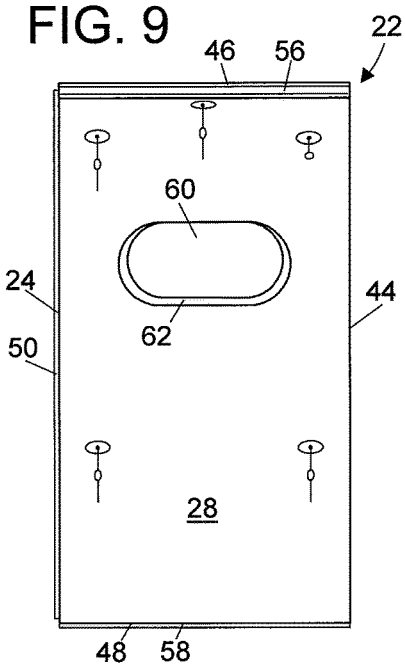
FIG. 9 is an interior elevation view of the first panel.

First panel 22 further includes a viewing aperture 60 which serves as a window and permits shelter occupants to see exterior of shelter 20 (refer also to FIGS. 4 and 5). In the shown embodiment viewing aperture 60 is oval and oriented horizontally. However, it may be appreciated that other shapes such as circular or rectangular, and a vertical orientation can be utilized. In the shown embodiment viewing aperture 60 has beveled sides 62. Referring also to FIGS. 33-35, a plug 64 has beveled edges 66. Plug 64 is shaped and dimensioned to removably fit into viewing aperture 60, and thereby provide a thermal seal during periods when viewing is not required. It is noted that plug 64 is fit into and removed from viewing aperture 60 from interior shelter 20 (also refer to FIGS. 36-39).

FIGS. 15-19 are top plan, exterior elevation, edge elevation, interior elevation, and opposite edge elevation views respectively of second panel 30. In the shown embodiment second panel 30 is shaped in the form of a 90° arc (refer to FIGS. 17 and 19). Second panel 30 includes side edge 32, exterior 34 (i.e. the part which is outwardly facing in FIG. 5), interior 36 (i.e. the part which is inwardly facing), opposite side edge 68, a top edge 70, and a bottom edge 72. Side edge 32 includes the other of a ridge and a groove from side edge 24 of first panel 22 (refer to FIGS. 6-10). Also referring to FIG. 20, in the shown embodiment side edge 32 includes a groove 74 which is shaped and dimensioned to receive ridge 50 of side edge 24 of first panel 22 (refer to FIG. 26). Referring also to FIG. 21, opposite side edge 68 includes a ridge 76. That is, in the shown embodiment one side edge 32 of second panel 30 has a groove 74 which extends the length of the side edge 32, and the opposite side edge 68 has a ridge 76 which extends the length of the side edge 68. As with first panel 22, ridge 76 is formed by a rod. In the shown embodiment ridge 76 is a pvc pipe which is fixedly connected (such as by an adhesive) to the wall of a semicircular cavity 78 which runs along side edge 68.

Referring also to FIG. 22, top edge 70 includes the other of a top ridge and a top groove from top edge 46 of first panel 22 (refer to FIGS. 6-10). In the shown embodiment top edge 70 includes a top groove 80, which is similarly formed as side groove 74. Top groove 80 is shaped and dimensioned to receive top ridge 56 of first panel 22 (refer to FIGS. 6-10). Referring also to FIG. 23, bottom edge 72 includes a bottom ridge 82, which is similarly formed as ridge 50 (refer to FIGS. 6-10). Bottom ridge 82 serves as a bumper which protects bottom edge 72 from damaging contact with support surface 500 (refer to FIG. 5).

As with first panel 22, second panel 30 also includes a viewing aperture 60 and plug 64 (refer to the discussion above for first panel 22).

Figure 2:
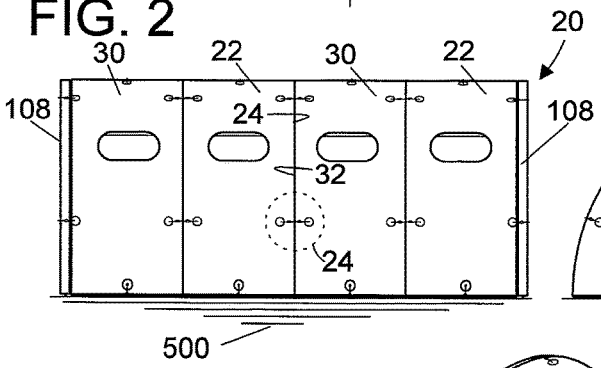
FIG. 2 is a reduced side elevation view of the shelter.
Figure 3:
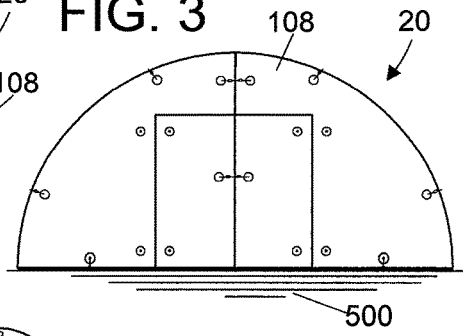
FIG. 3 is a reduced end elevation view of the shelter.

FIG. 24 is an enlarged view of area 24 of FIG. 2, FIG. 25 is a cross sectional view along line 26-25 of FIG. 24 showing first panel 22 and the second panel 30 connected, and FIG. 26 is a cross sectional view as in FIG. 25 showing first panel 22 and second panel 30 before connection. As discussed above, a plurality of connectors 40 are utilized to connect first panels 22 to second panels 30. Each connector 40 includes an exterior segment 42 and an interior segment 44, so that at the connections both the exterior and the interior of the panels are forced into abutting relationship. Exterior segment 42 includes an exterior elastic cord 41 (two in the shown embodiment) which is configured to pull first panel 22 and second panel 30 together in the direction of the arrows in FIG. 25. In the shown embodiment elastic cord 41 is a bungee cord. Exterior segment 42 also includes an exterior hook 43 (fabricated from metal or plastic) which is configured to engage an exterior loop 45 (a loop in exterior elastic cord 41). In use, the length of exterior elastic cord 41 is designed so that it must be stretched in order for exterior hook 43 to engage exterior loop 45. As such, when the hook is connected to the loop exterior elastic cord 41 resiliently urges first panel 22 and second panel 30 together in abutting contact. Similar to exterior segment 42, interior segment 44 includes an interior elastic cord 47 (two in the shown embodiment) which is configured to pull first panel 22 and second panel 30 together. Interior segment 44 further includes an interior hook 49 which is configured to engage an interior loop 51 (the same as exterior loop 45). In FIG. 26 it is noted that ridge 50 of first panel 22 is shaped and dimensioned to closely fit into groove 74 of second panel 30. The ridge and groove connection provides structural strength and prevents lateral relative movement of the panels. It is noted that in the shown embodiment the aforementioned connector 40 is used to effect all of the connections of first panel 22 to second panel 30, both on the sides and tops of the panels. It is further noted that first panel 22 and second panel 30 are identical with the exception that (1) first panel 22 has a ridge 56 on top edge 46 (refer to FIG. 13) while second panel 30 has a groove 80 on top edge 70 (refer to FIG. 22), and (2) connector 40 at the top of first panel 22 has exterior 43 and interior 49 hooks while second panel 30 has exterior 45 and interior 51 loops.

Figure 27:
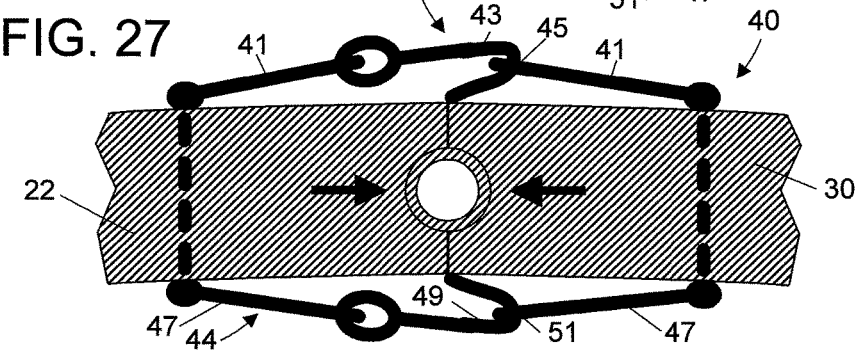
FIG. 27 is an enlarged cross sectional view along the line 27-27 of FIG. 1.

FIG. 27 is an enlarged cross sectional view along the line 27-27 of FIG. 1 which shows the top connection of first panel 22 to second panel 30. The top connection is the same as the previously described side connection. Shown are first panel 22, second panel 30, connector 40, exterior segment 42, exterior elastic cord 41, exterior hook 43, exterior loop 45, interior segment 44, interior elastic cord 47, interior hook 49, and interior loop 51.

Figure 7:
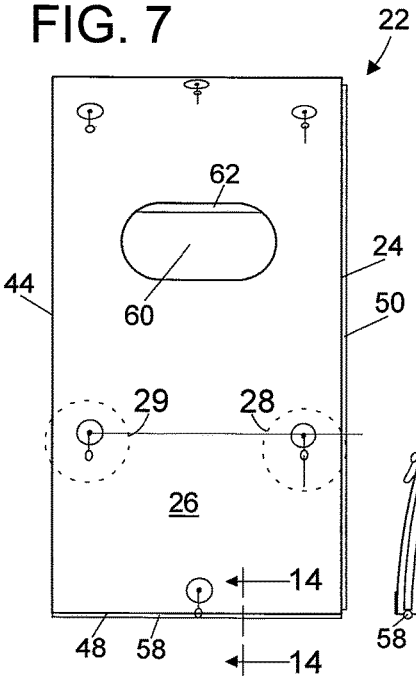
FIG. 7 is an exterior elevation view of the first panel.
Figure 8:
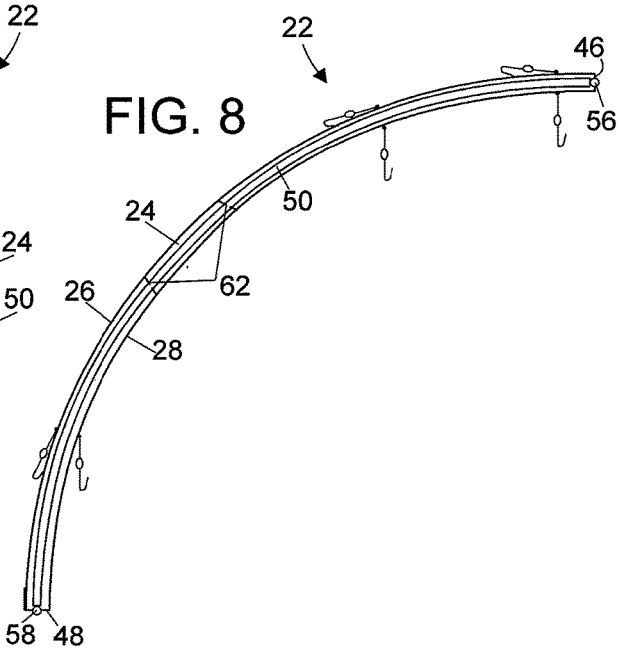
FIG. 8 is an edge elevation view of the first panel.
Figure 15:
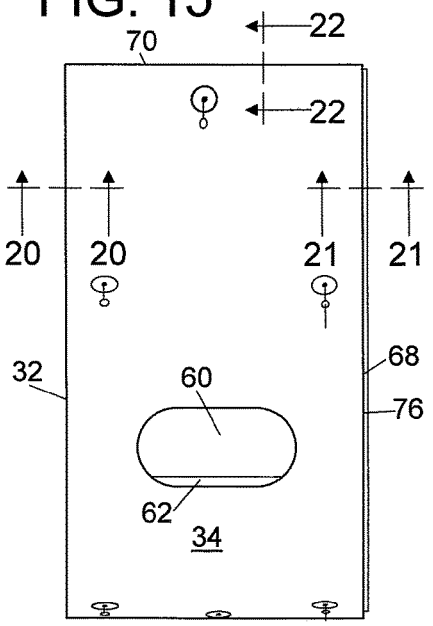
FIG. 15 is top plan view of a second panel.
Figure 18:
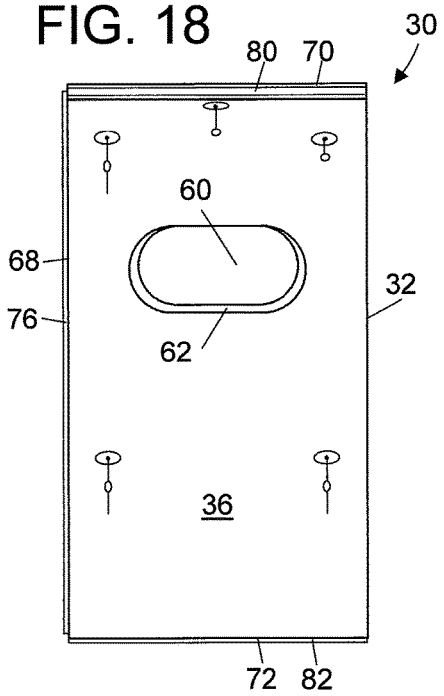
FIG. 18 is an interior elevation view of the second panel.
Figure 16:
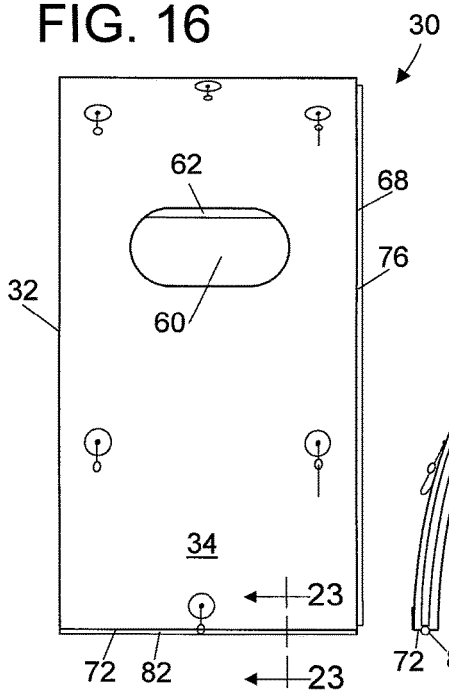
FIG. 16 is an exterior elevation view of the second panel.
Figure 17:
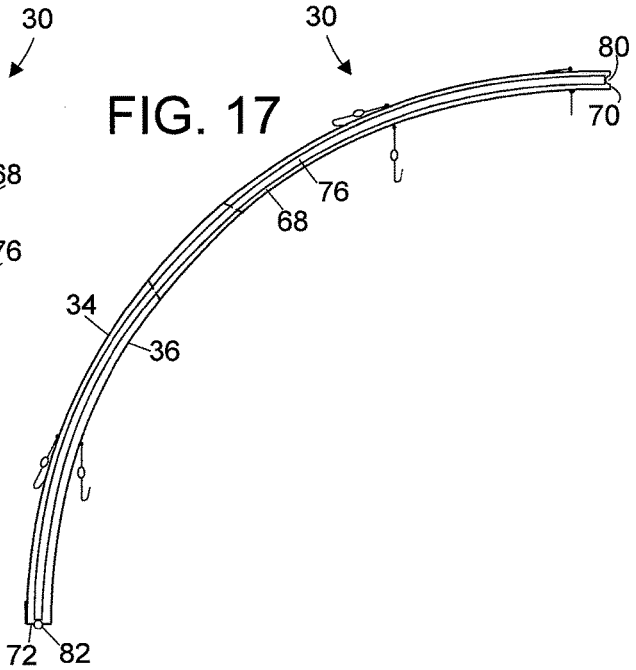
FIG. 17 is an edge elevation view of the second panel.
Figure 28:
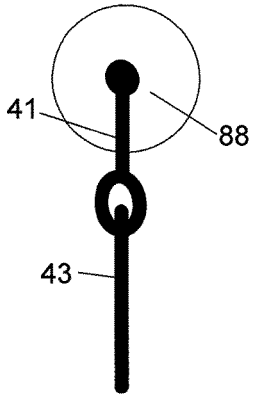
FIG. 28 is an enlarged view of area 28 of FIG. 7.
Figure 29:
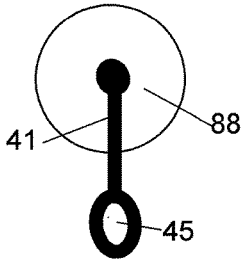
FIG. 29 is an enlarged view of area 29 of FIG. 7.

FIG. 28 is an enlarged view of area 28 of FIG. 7 which shows exterior elastic cord 41 and exterior hook 43 hanging down in a disengaged state. FIG. 29 is an enlarged view of area 29 of FIG. 7 which shows exterior elastic cord 41 and exterior loop 45 hanging down in a disengaged state.

Figure 30:
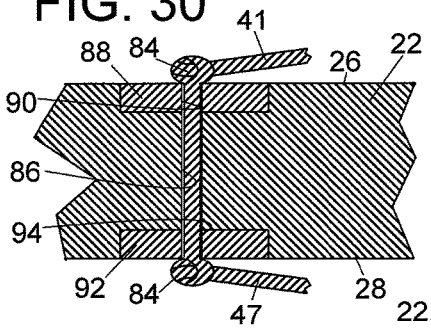
FIG. 30 is an enlarged cross sectional view along line 30-30 of FIG. 24.

FIG. 30 is an enlarged cross sectional view along line 30-30 of FIG. 24. It is noted that in the shown embodiment exterior elastic cord 41 and interior elastic cord 47 are formed from a single cord which extends through a hole 86 from the exterior 26 of first panel 22 to the interior 28 of first panel 22. Knots 84 are tied in the cord to hold it in position within hole 86. It may be appreciated that the same single cord design is also used in second panel 30. Exterior 26 of first panel 22 includes an exterior resin inset 88 which has a hole 90 which is configured to receive exterior elastic cord 41 (also refer to FIGS. 28 and 29). Interior 28 of first panel 22 includes an interior resin inset 92 which has a hole 94 which is configured to receive interior elastic cord 47. In an embodiment, resin insets 88 and 92 are fabricated from fiberglass resin and are in the form of discs which are inset into the surface of the panel (also refer to FIGS. 28 and 29). A cavity is made in first panel 22 and the fiberglass resin is poured into the cavity. When the resin has cured, holes 90 and 94 are drilled to accept the elastic cord. It may be appreciated that the same resin inset design is utilized for the portion of connector 40 which is attached to second panel 30.

Figure 32:
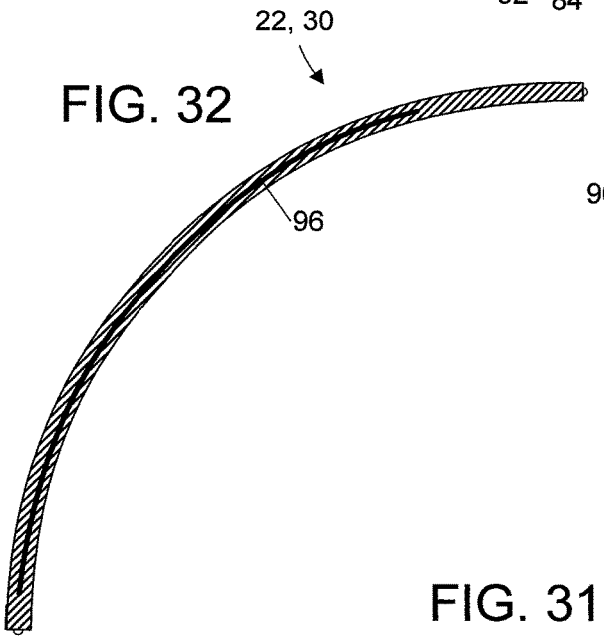
FIG. 32 is a cross sectional view along the line 32-32 of FIG. 31.
Figure 31:
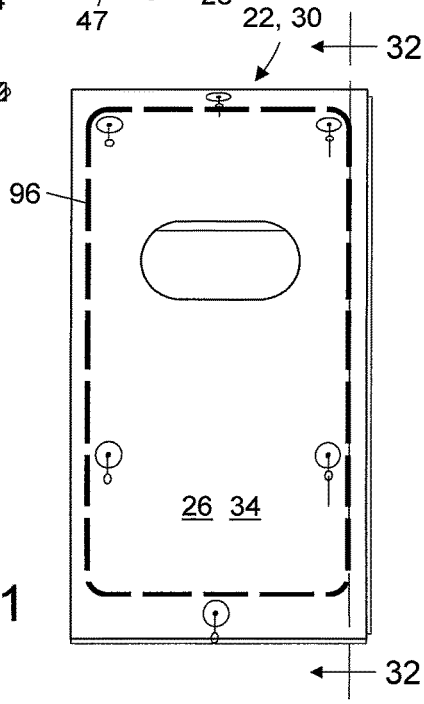
FIG. 31 is an exterior elevation view of the first panel or the second panel including an embedded support frame.

FIG. 31 is an exterior elevation view of first panel 22 including an embedded support frame 96, and FIG. 32 is a cross sectional view along the line 32-32 of FIG. 31. First panel 22 and second panel 30 each include the embedded support frame 96. Support frame 96 is fabricated from a metal or other ridged material and thereby provides structural strength to the panels.

FIGS. 33-35 are exterior elevation, interior elevation, and end elevation views respectively of plug 64. As previously discussed, plug 64 fits into viewing aperture 60 in first panel 22 or second panel 30 to close the opening when viewing is not required. Plug 64 has beveled edges 66 which are shaped and dimensioned to fit into the beveled sides 62 of viewing aperture 60.

FIGS. 36-41 are various views showing plug 64 and viewing aperture 60. A lock 98 is configured to hold plug 64 in place within viewing aperture 60. Lock 98 includes a sleeve 100 (e.g. a piece of PVC) which cooperates with an elastic plug cord 102 which is connected to the interior 28 or 36 of first panel 22 or second panel 30 respectively. That is, elastic plug cord 102 has two ends which are connected at different points to the interior 28 of first panel 22, or to the interior 36 of second panel 30. Sleeve 100 is positionable along elastic plug cord 102 (see arrows in FIG. 38) to a locked position in which it perpendicularly abuts plug 64. In the locked position, sleeve 100 is disposed between elastic plug cord 102 and plug 64, wherein sleeve 100 urges plug 64 into viewing aperture 60 in the direction of the larger arrow of FIG. 38. That is, sleeve 100 is moved along elastic plug cord 102 until it is perpendicular to plug 64. The resiliency of elastic plug cord 102 then urges sleeve 100 toward plug 64 to hold plug 64 in place within viewing aperture 60. Referring to FIGS. 38 and 39, sleeve 100 is connected to plug 64 by a cord 104. The distal end of cord 104 has a loop 106 which permits sleeve 100 to slide along elastic plug cord 102. In FIGS. 40 and 41, lock 98 has been disengaged and sleeve 100 and plug 64 moved down along elastic plug cord 102 and rotated so that viewing aperture 60 is open. Plug 64 can be reinstalled in viewing aperture 60 by moving sleeve 100 and plug 64 back into the position of FIGS. 36-39.

FIG. 42 is a reduced perspective view of shelter 20 with plugs 64 installed in viewing apertures 60.

Figure 43:
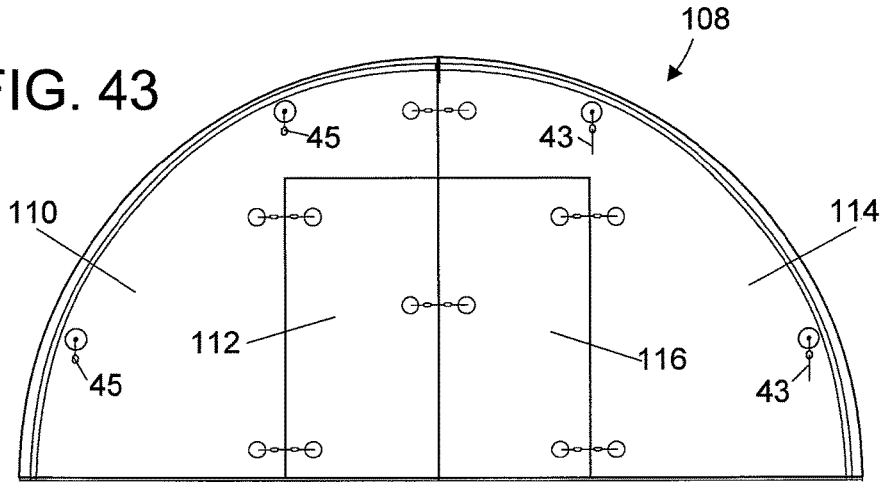
FIG. 43 is an interior elevation view of an end panel.
Figure 44:
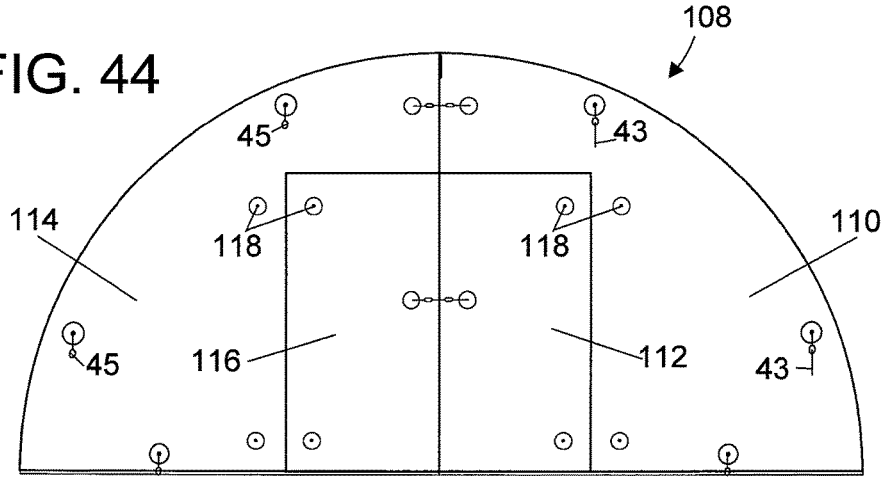
FIG. 44 is an exterior elevation view of the end panel.
Figure 45:
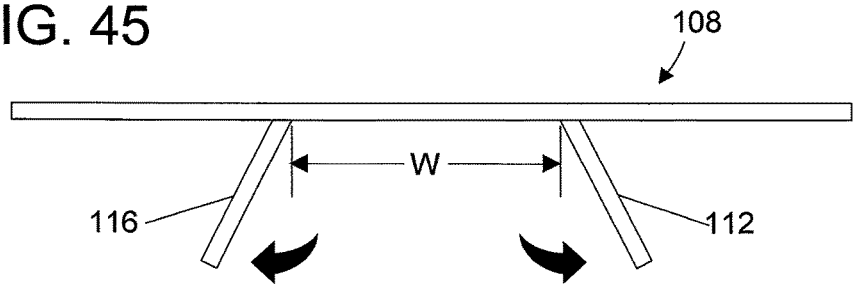
FIG. 45 is top plan view of the end panel with doors open.

FIG. 43-45 are interior elevation, exterior elevation, and top plan views respectively of an end panel 108 (also refer to FIG. 5). In the shown embodiment, end panel 108 includes a first half panel 110 which includes a first door 112, and a second half panel 114 which includes a second door 116. The panels include both hooks 43 and loops 45 to effect connection to first panel 22 and second panel 30 (refer to FIG. 5 and FIGS. 24-26). First 112 and second 116 doors open in double door fashion, and have a width W which is wide enough to accommodate a wheelchair. Shelter 20 also includes another end panel 108 at its opposite end (refer to FIG. 5). The opposite end panel may or may not have doors 112 and 116. On FIG. 44 it is noted that on the exterior of shelter 20 first door 112 is not connected to first half panel 112, and that second door 116 is not connected to second half panel 114. Rather knots 118 are tied in the elastic cord to hold the cord in place with respect to the resin inset 88 (refer to FIG. 30). The connection of the doors to the half panels is made on the interior only.

Figure 46:
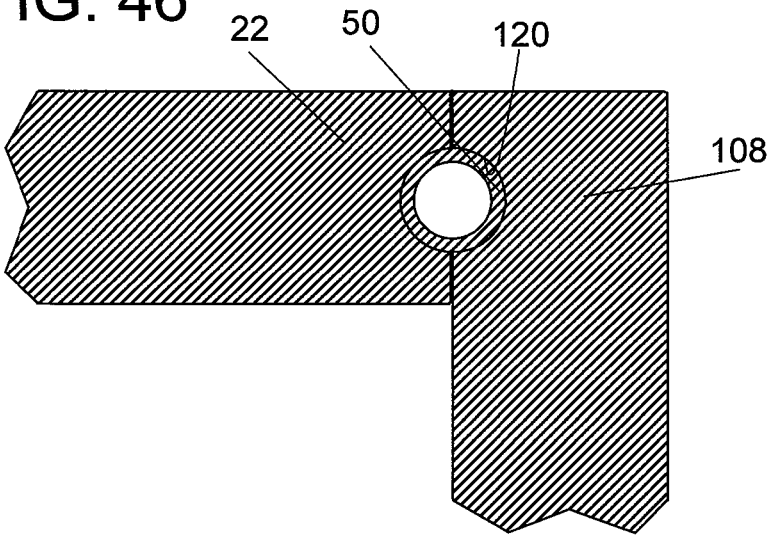
FIG. 46 is an enlarged cross sectional view along the line 46-46 of FIG. 1.

FIG. 46 is an enlarged cross sectional view along the line 46-46 of FIG. 1, which shows the connection of first panel 22 to end panel 108. First panel 22 has a side ridge 50 which engages a groove 120 in end panel 108.

In terms of use, a method for assembling a shelter 20 includes:

(a) providing a plurality of panels including a first panel 22 having a side edge 24, an exterior 26, and an interior 28, and a second panel 30 having a side edge 32, an exterior 34, and an interior 36;

(b) providing a connector 40 which is configured to hold the side edge 24 of the first panel 22 in abutting relationship with the side edge 32 of the second panel 30, the connector 40 including an exterior segment 42 which is configured to connect the exterior 26 of the first panel 22 to the exterior 34 of the second panel 30, and an interior segment 44 which is configured to connect the interior 36 of the first panel 22 to the interior 36 of the second panel 30;

(c) placing the side edge 24 of the first panel 22 into abutting relationship with the side edge 32 of the second panel 30;

(d) using the exterior segment 42 to connect the exterior 26 of the first panel 22 to the exterior 34 of the second panel 30; and, (e) using the interior segment 44 to connect the interior 28 of the first panel 22 to the interior 36 of the second panel 30.

The method further including:

in (b) the exterior segment 42 including an exterior elastic cord 41 which is configured to pull the first panel 22 and the second panel 30 together;

in (b), the interior segment 44 including an interior elastic cord 47 which is configured to pull the first panel 22 and the second panel 30 together;

in (d), the exterior elastic cord 41 pulling the first panel 22 and the second panel 30 together; and, in (e), the interior elastic cord 47 pulling the first panel 22 and the second panel 30 together.

The method further including:

in (b), the exterior segment 42 including an exterior hook 43 which is configured to engage and exterior loop 45, and the interior segment 44 including an interior hook 49 which is configured to engage an interior loop 51, and;

in (d), connecting the exterior hook 43 to the exterior loop 45; and, in (e), connecting the interior hook 49 to the interior loop 51.

Note—Unless specifically otherwise stated, and as applicable, the order of performance of the above cited method steps can be changed.

The embodiments of the shelter and method of use described herein are exemplary and numerous modifications, combinations, variations, and rearrangements can be readily envisioned to achieve an equivalent result, all of which are intended to be embraced within the scope of the appended claims. Further, nothing in the above-provided discussions of the shelter and method should be construed as limiting the invention to a particular embodiment or combination of embodiments. The scope of the invention is defined by the appended claims.

I claim:

1. A shelter, comprising:

a plurality of panels including a first panel having a side edge, an exterior, and an interior, and a second panel having a side edge, an exterior, and an interior;

a connector which is configured to hold said side edge of said first panel in abutting relationship with said side edge of said second panel;

said connector including an exterior segment which is configured to connect said exterior of said first panel to said exterior of said second panel, and an interior segment which is configured to connect said interior of said first panel to said interior of said second panel;

said exterior segment including an exterior elastic cord which is configured to pull said first panel and said second panel together; and, said interior segment including an interior elastic cord which is configured to pull said first panel and said second panel together.

2. The shelter according to claim 1, further including:

said exterior segment including an exterior hook which is configured to engage an exterior loop;

said interior segment including an interior hook which is configured to engage an interior loop;

said first panel and said second panel each fabricated from foam;

said side edge of said first panel including one of a ridge and a groove;

said side edge of said second panel including the other of said ridge and said groove;

said ridge being a rod;

said first panel having a bottom edge, said bottom edge of said first panel including a bottom ridge;

said second panel having a bottom edge, said bottom edge of said second panel including a bottom ridge;

said first panel having a top edge, said top edge of said first panel including one of a top ridge and a top groove;

said second panel having a top edge, said top edge of said second panel including the other of said top ridge and said top groove;

said first panel and said second panel each including an embedded support frame;

said first panel including a viewing aperture;

a plug which is shaped and dimensioned to removably fit into said viewing aperture;

a lock which is configured to hold said plug in place within said viewing aperture; and, said lock including a sleeve which cooperates with an elastic plug cord, wherein said sleeve is positionable to a locked position in which it perpendicularly abuts said plug.

3. The shelter according to claim 1, further including:

said exterior segment including an exterior hook which is configured to engage an exterior loop; and, said interior segment including an interior hook which is configured to engage an interior loop.

4. The shelter according to claim 1, further including;

said exterior of said first panel including an exterior resin inset having a hole which is configured to receive said exterior elastic cord; and, said interior of said first panel including an interior resin inset having a hole which is configured to receive said interior elastic cord.

5. The shelter according to claim 1, further including:

said first panel and said second panel each fabricated from foam.

6. The shelter according to claim 1, further including:

said side edge of said first panel including one of a ridge and a groove; and, said side edge of said second panel including the other of said ridge and said groove.

7. The shelter according to claim 6, further including:

said ridge being a rod.

8. The shelter according to claim 1, further including:

said first panel having a bottom edge, said bottom edge of said first panel including a bottom ridge; and, said second panel having a bottom edge, said bottom edge of said second panel including a bottom ridge.

9. The shelter according to claim 1, further including:

said first panel having a top edge, said top edge of said first panel including one of a top ridge and a top groove; and, said second panel having a top edge, said top edge of said second panel including the other of said top ridge and said top groove.

10. The shelter according to claim 1, further including:

said first panel and said second panel each including an embedded support frame.

11. A shelter, comprising:

a plurality of panels including a first panel having a side edge, an exterior, and an interior, and a second panel having a side edge, an exterior, and an interior;

a connector which is configured to hold said side edge of said first panel in abutting relationship with said side edge of said second panel;

said connector including an exterior segment which is configured to connect said exterior of said first panel to said exterior of said second panel, and an interior segment which is configured to connect said interior of said first panel to said interior of said second panel;

said first panel including a viewing aperture;

a plug which is shaped and dimensioned to removably fit into said viewing aperture;

a lock which is configured to hold said plug in place within said viewing aperture; and, said lock including a sleeve which cooperates with an elastic plug cord, wherein said sleeve is positionable to a locked position in which it perpendicularly abuts said plug.

12. The shelter according to claim 11, further including:

said elastic plug cord having two ends which are connected at different points to said interior of said first panel; and, in said locked position said sleeve is disposed between said elastic plug cord and said plug, wherein said sleeve urges said plug into said viewing aperture.

13. A method for assembling a shelter, comprising:

(a) providing a plurality of panels including a first panel having a side edge, an exterior, and an interior, and a second panel having a side edge, an exterior, and an interior;

(b) providing a connector which is configured to hold said side edge of said first panel in abutting relationship with said side edge of said second panel, said connector including an exterior segment which is configured to connect said exterior of said first panel to said exterior of said second panel, and an interior segment which is configured to connect said interior of said first panel to said interior of said second panel;

(c) placing said side edge of said first panel into abutting relationship with said side edge of said second panel;

(d) using said exterior segment to connect said exterior of said first panel to said exterior of said second panel;

(e) using said interior segment to connect said interior of said first panel to said interior of said second panel;

in (b), said exterior segment including an exterior elastic cord which is configured to pull said first panel and said second panel together;

in (b), said interior segment including an interior elastic cord which is configured to pull said first panel and said second panel together;

in (d), said exterior elastic cord pulling said first panel and said second panel together; and, in (e), said interior elastic cord pulling said first panel and said second panel together.

14. The method of claim 13, further including:

in (b), said exterior segment including an exterior hook which is configured to engage an exterior loop, and said interior segment including an interior hook which is configured to engage an interior loop, in (d), connecting said exterior hook to said exterior loop; and, in (e), connecting said interior hook to said interior loop.

* * * * *